United States Patent [19]

Swinton

[11] Patent Number: 4,713,658

[45] Date of Patent: Dec. 15, 1987

[54] APPARATUS FOR PROVIDING A VISUAL INTERPRETATION OF AN AUDIO SIGNAL

[76] Inventor: Andrew D. Swinton, 24D Cricket Ground Road, Norwich, United Kingdom

[21] Appl. No.: 752,361

[22] Filed: Jul. 5, 1985

[51] Int. Cl.[4] ..... G08B 5/22

[52] U.S. Cl. ..... 340/815.11; 340/815.08; 340/815.19; 340/815.26; 84/464 R

[58] Field of Search ..... 340/815.06, 815.08, 340/815.11, 815.19, 815.26, 755, 764; 84/464 R, 477 B; 367/198, 199

[56] References Cited

U.S. PATENT DOCUMENTS

| | | | |
|---|---|---|---|
| 1,188,118 | 6/1916 | Tregoning | 340/815.19 |
| 3,149,430 | 9/1964 | Szabo | 340/815.08 |
| 3,205,755 | 9/1965 | Sklar | 84/464 R |
| 3,478,637 | 11/1969 | Reed et al. | 84/464 R |
| 3,594,785 | 7/1971 | Orenbuch | 340/815.08 |
| 3,885,797 | 5/1975 | Booty et al. | 84/464 R |
| 3,924,231 | 12/1975 | McClure | 340/815.11 |
| 4,034,215 | 7/1977 | Hashimoto | 84/464 R |
| 4,097,917 | 6/1978 | McCaslin | 84/464 R |

*Primary Examiner*—Gerald L. Brigance
*Assistant Examiner*—Jeffery A. Brier
*Attorney, Agent, or Firm*—Neal J. Mosely

[57] ABSTRACT

There is disclosed an apparatus for displaying in visual form the qualities of a musical signal. The signal is analyzed electronically into components based on the frequency characteristic or amplitude characteristic of the signal. Each component controls a motor operating a rotable indicator. Preferably the amplitude component causes rotation of the whole indicator display, which consists of three indicator sets, one for each of bass, treble and mid-range. Each indicator set may be subdivided within further frequency limits.

8 Claims, 7 Drawing Figures

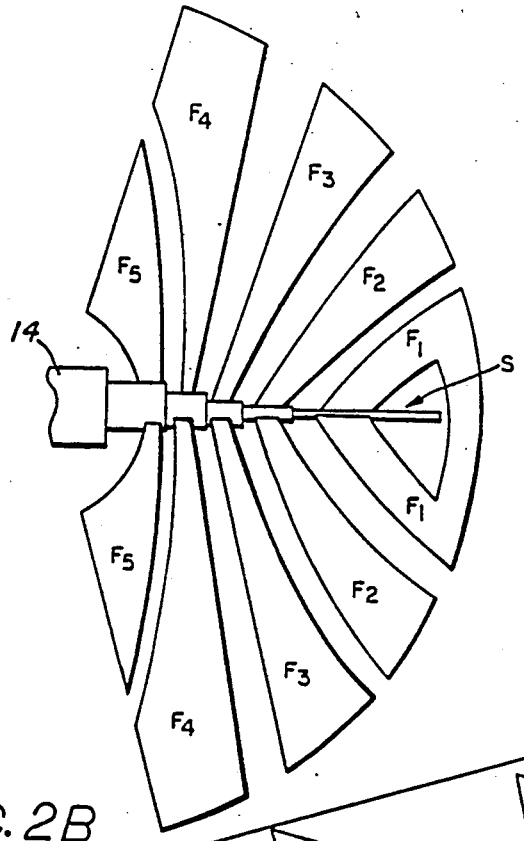
FIG. 2C
MID RANGE FIN
FIG. 2B
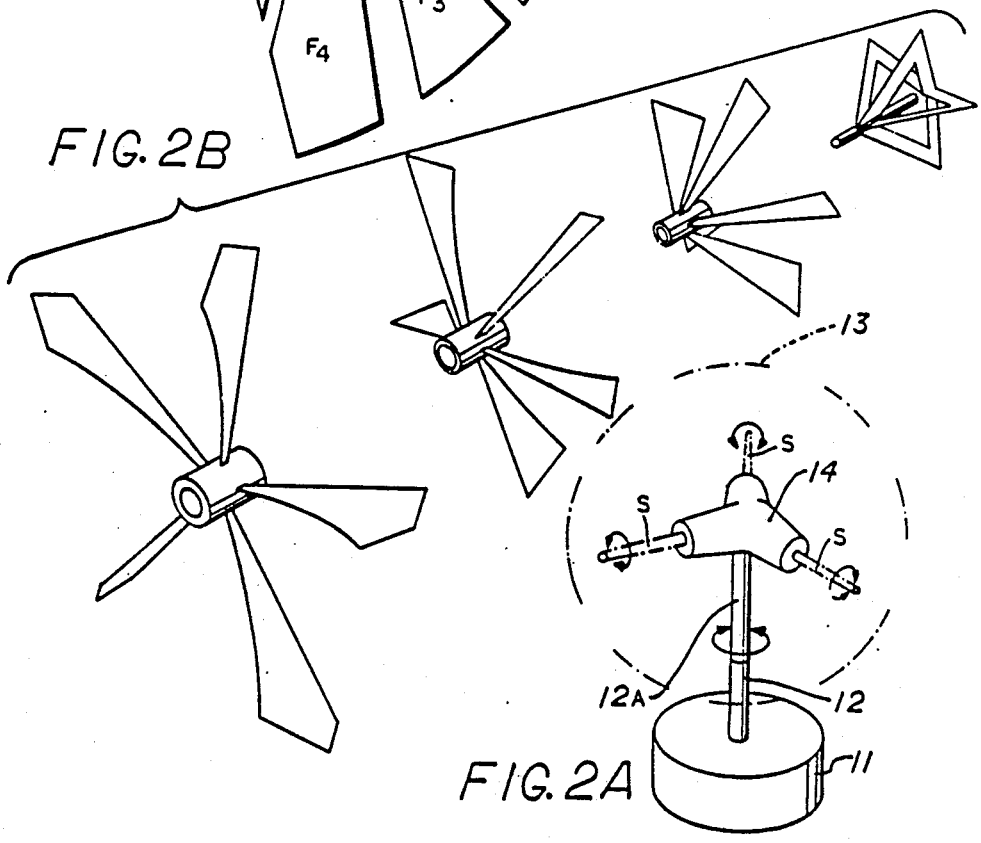
FIG. 2A

APPARATUS FOR PROVIDING A VISUAL INTERPRETATION OF AN AUDIO SIGNAL

FIELD OF THE INVENTION

The invention relates to electromechanical apparatus for analysing the sound spectrum of music and translating the results into a range of observable movements.

BACKGROUND TO THE INVENTION

Most people, when listening to recorded music, will occasionally glance at the sound source as a particular sound or combination of sound reaches their consciousness, as if in need of an explanation or a further stimulation at that particular time. The conventional sound-transmitting speaker is of course incapable of providing that further stimulation, but it is almost as if the listener half-expects that by looking at the source of the sound he could thereby appreciate it better. There will always be purists who choose to listen to music visually unaided, with their eyes closed, and perhaps create their own abstract images within their own mind either consciously or subconsciously. Despite this, however, there must be a market for an apparatus capable of translating recorded or live music into a range of observable movements.

Electronic systems for analysing recorded sound and translating the results into observable form are already known. These are typified by the modern flashing-light units used in discotheques and now used by an increasing number of performers as part of their on-stage equipment. The electronic circuitry for such systems is, however, not usually designed to drive an inductive load such as a variable-speed electric motor, and the visual effects produced by these systems contain no moving element.

REVIEW OF THE PRIOR ART

One system which has been developed to give a lighting effect from a sound system is described in UK Patent Specification No. 1295 065. This describes a system where white light is shone through a pair of overlapping birefringent elements. The elements are mounted for rotation; and the drive for the rotation is coupled to a sound amplifier so that as the amplitude of the sound changes the speed of rotation changes. The rotation causes a visual effect of changing fringes. The system also can shine the white light through a vane which can be rotated to change the colour of the light effect. This vane may in some cases may be coupled to a counter which responds in changes of frequency of the sound signal, so that the colour of the visual effect may change in accordance with the frequency of the sound.

Although this creates interesting lighting effects, they are not very helpful in the interpretation of the sounds into the separate characteristics of sound, ie that of pitch and amplitude. It is not possible to represent with any effect a combination of sounds of different frequencies for example.

SUMMARY OF THE INVENTION

According to the invention, there is provided apparatus for providing a visual interpretation of an audio signal, the apparatus comprising:

a electronic analyser, including means to receive an audio signal; means to analyse the audio signal into a plurality of characteristic components, each characteristic component being based on one of the characteristics, amplitude and frequency, the plurality of components including at least two components based on the same characteristic and means to produce for each component an electrical signal representatative of that component of the audio signal received by the analyser; and for each component:

a housing; an inductive motor housed within the housing;

a shaft; visible indicator means; means mounting said visible indicator means on said shaft; means rotatably mounting said shaft onto said housing; means drive the coupling said inductive motor to said shaft whereby to rotate said shaft by said motor; and, motor control means coupled between said electric analyser and said inductive motor, including means to receive the electrical signal representing the component and drive the motor therefrom whereby to rotate the shaft and the visible indicator means to produce a visual effect representative of the component of the audio signal.

Thus a visible effect can be observed where separate visible indicators are rotated, due to the presence of a particular characteristic, component of the audible signal.

This is particularly useful when the main characteristic chosen is frequency, since many different frequencies are usually present in a sound, and an interesting observable interpretation of each sound may be produced.

Preferably each inductive motor comprises a dual-directional variable speed motor, so that the speed and direction of each shafts rotation may be changed due to changes in properties of the audible signal.

The indicators may comprise an array of fins each carried by a respective one of the motor output shafts.

Some of the motor output shafts may be mounted for concentric but respectively independent rotation.

One electronic analyser suitable for use with apparatus embodying the invention is known commercially as a Pulsar Zero 3000 Mark II and is currently available from Pulsar Light of Cambridge Limited, Cambridge, England. This unit is capable of controlling inductive loads such as electric motors. It may also be used to control different types of load in combination. Thus the rotary movement may be combined with flashing lights and other effects.

Where an array of fins is used as outlined above, the fins may be chromium-plated light alloy or they could alternatively or additionally be glass or translucent plastics, faceted to give crystalline reflective effects as they move. Liquid crystal display, fibre optics, within the glass or plastics fins, could be used to enhance the visual effects produced.

The fins and their shafts could be encased in a translucent sphere which could itself rotate either independently or in accordance with the dictates of any one of the sound component drives. The sphere could incorporate any of the visually-enhancing aids just outlined.

A column supporting the fins and their driving motors could itself, for example, respond to changes in sound amplitude by rotating either faster or slower as the amplitude respectively increases or decreases. Such a column could support, and/or rotate, the sphere mentioned above.

Very large versions of apparatus embodying the invention could be suspended above full orchestras or bands, simultaneously interpreting the music as it is being created. In such circumstances the apparatus would of course normally be turned off during subsequent applause from the audience, so as not to inadvertently be energised and detract attention from the musicians at the moment of their audience appreciation.

For home use, smaller versions of the apparatus could be combined with an otherwise conventional sound broadcasting loadspeaker.

Such units would then contain the sound-broadcasting source as well as the means for visual interpretaion of the sounds produced.

The movements of apparatus embodying the invention would normally be controlled by sound frequencies within the human audio spectrum of approximately 20 Hertz to 20,000 Hertz. Thus a bass-responsive motor-driving sound component would be actuated by frequencies between 20 Hertz and 100 Hertz, the mid-range from 100 Hertz upwards to 15,000 Hertz, and the treble from 15,000 Hertz to 20,000 Hertz.

BRIEF DESCRIPTION OF THE DRAWINGS

In one specific embodiment of the invention, three groups of concentrically-mounted shafts radiate from a head which carries the shaft-driving motors and which is itself driven about a supporting column. That embodiment will now be described with reference to the accompanying drawings, in which:

FIGS. 2A to 2C show various pictorial views of the parts of the apparatus;

DESCRIPTION OF THE PREFERRED EMBODIMENT

Figure 1A:
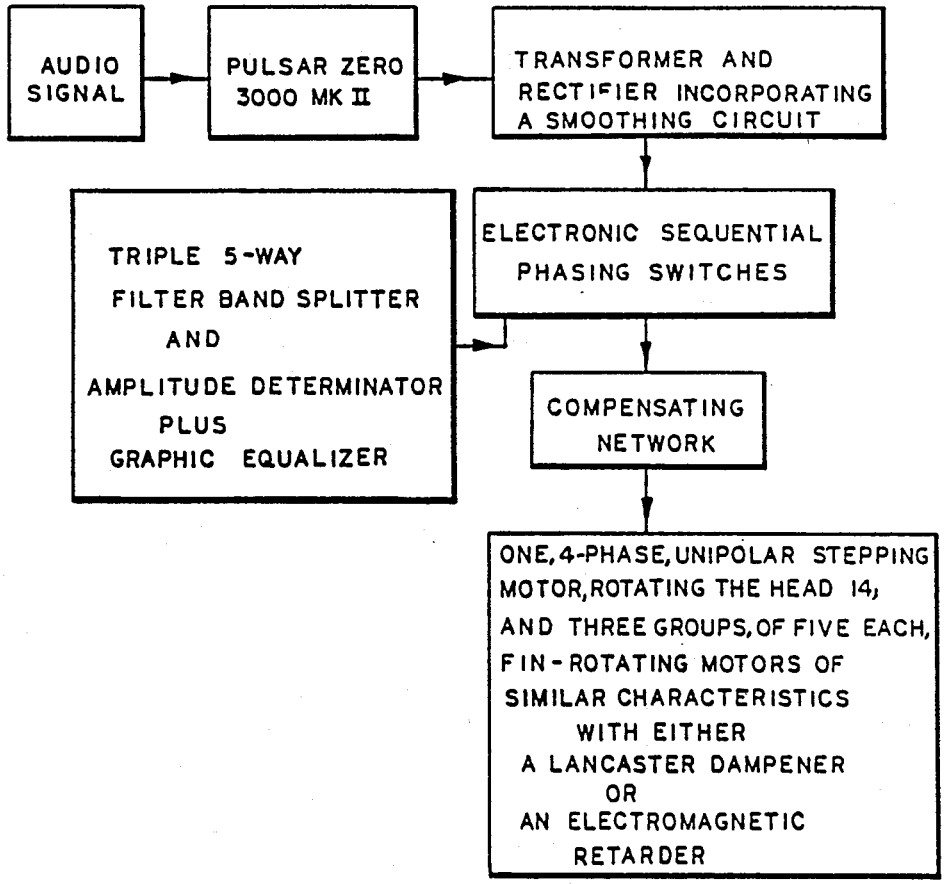
FIG. 1A is a block diagram showing the layout of the apparatus.
Figure 1B:
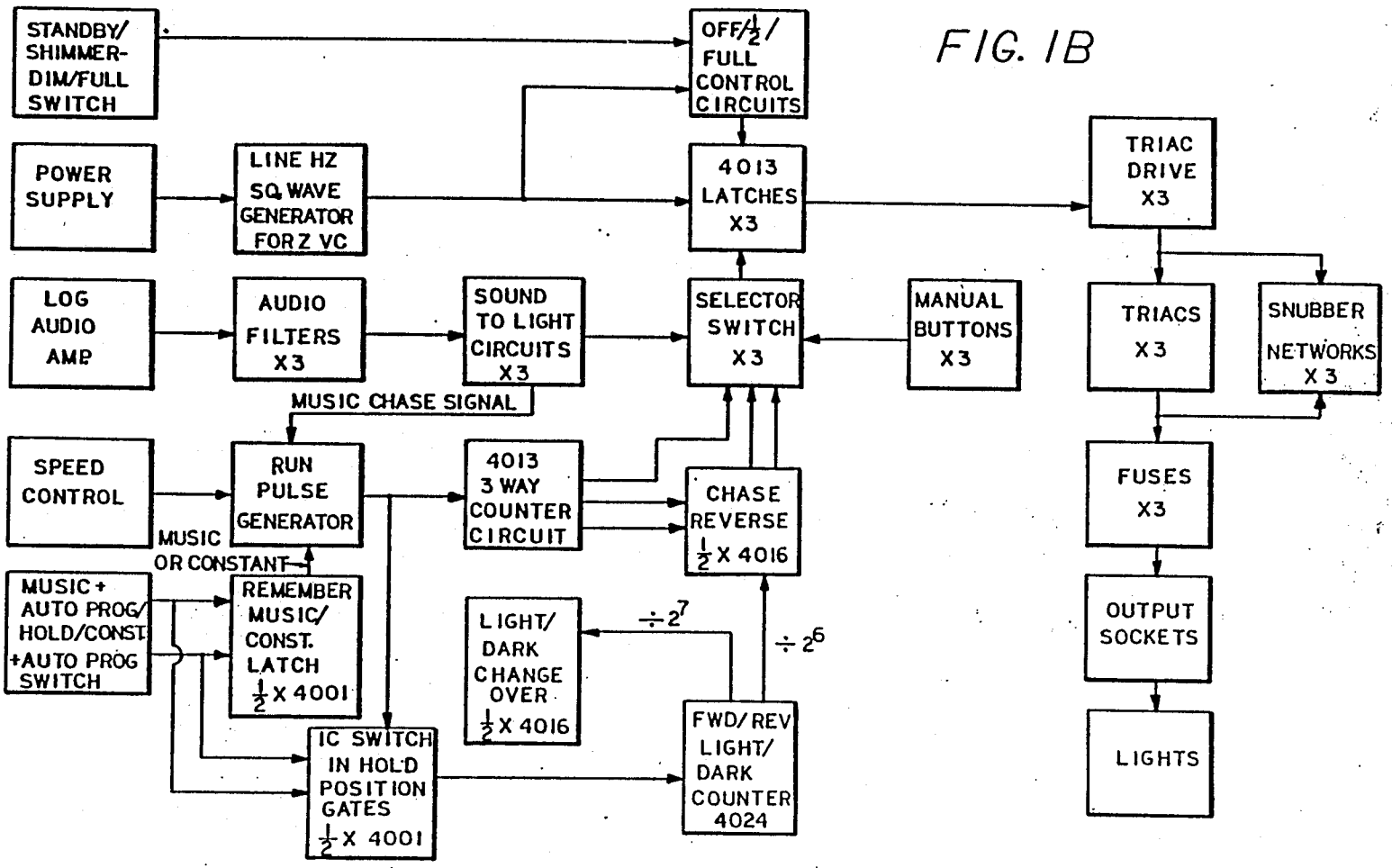
FIG. 1B is a block diagram of the analyser.

The apparatus stands on a base which is referenced 11 and which contains the electronic circuitry. The base 11 incorporates one or more input terminals for an audio-based electronics signal. The base also incorporates the Pulsar Zero 3000 Mark II electronic analyser previously referred to. FIG. 2A shows the rest of the electronic circuitry housed in the base and sending its decoded impulses via suitable transmission lines up a hollow column 12 supporting a translucent plastics sphere 13.

An extension **12*a* of the column 12 supports a head 14. The head 14 has three limbs each equally circumferentially spaced from one another and each radiating from the column extension 12*a*. A respective group of drive shafts projects from each limb of the head 14. The motors whose output shafts drive these drive shafts are housed in the head 14**.

The supporting column 12 can rotate on its base 11 under the control of its own drive motor, not illustrated in any of the drawings. When the column 12 rotates, the sphere 13 rotates with it. The column extension **12*a* is carried round with the column 12 on rotation, and so the head 14 rotates as a unit under the action of the drive motor rotating the column 12 and the sphere 13**.

Figure 3:
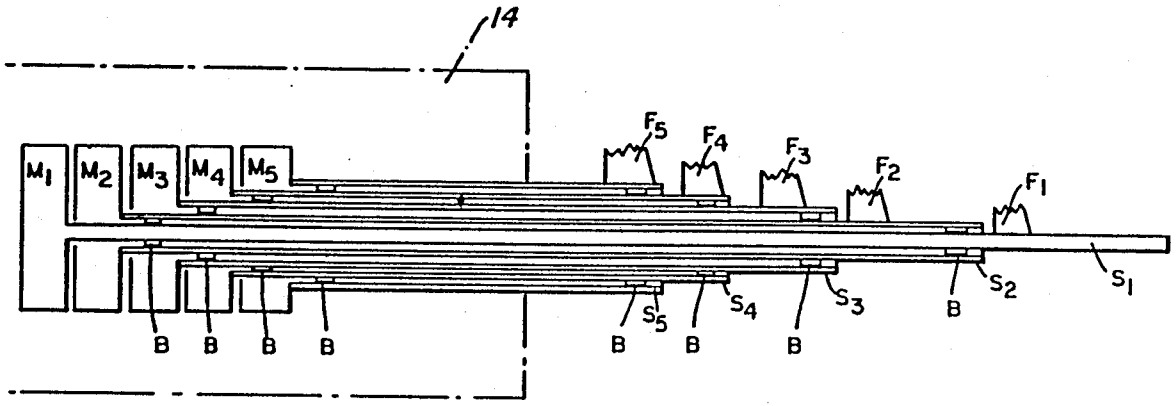
FIG. 3 shows in detail the drive shaft arrangement of the apparatus.

As FIG. 3 shows, each group of drive shafts projecting from each limb of the head 14 consists of five shafts S concentrically mounted. All but the smallest-diameter shaft are hollow, and rolling bearings B enable all five shafts to rotate concentrically but independently. Five motors M each have their output shafts connected to a respective one of the drive shafts S. Each of these motors is a dual-directional variable-speed inductive motor having substantially instantaneous response characteristics with substantial low-speed torque and essentially silent running characteristics.

Each of the five drive shafts S projecting from each limb of the head 14 carries a respective fin F. Each of these fins, as shown in FIG. 2B, takes the form of a five-bladed fan. All the fins are so spaced that they can rotate without clashing with one another. They are all made of relatively lightweight material which may be perforated to reduce wind resistance.

Figure 4:
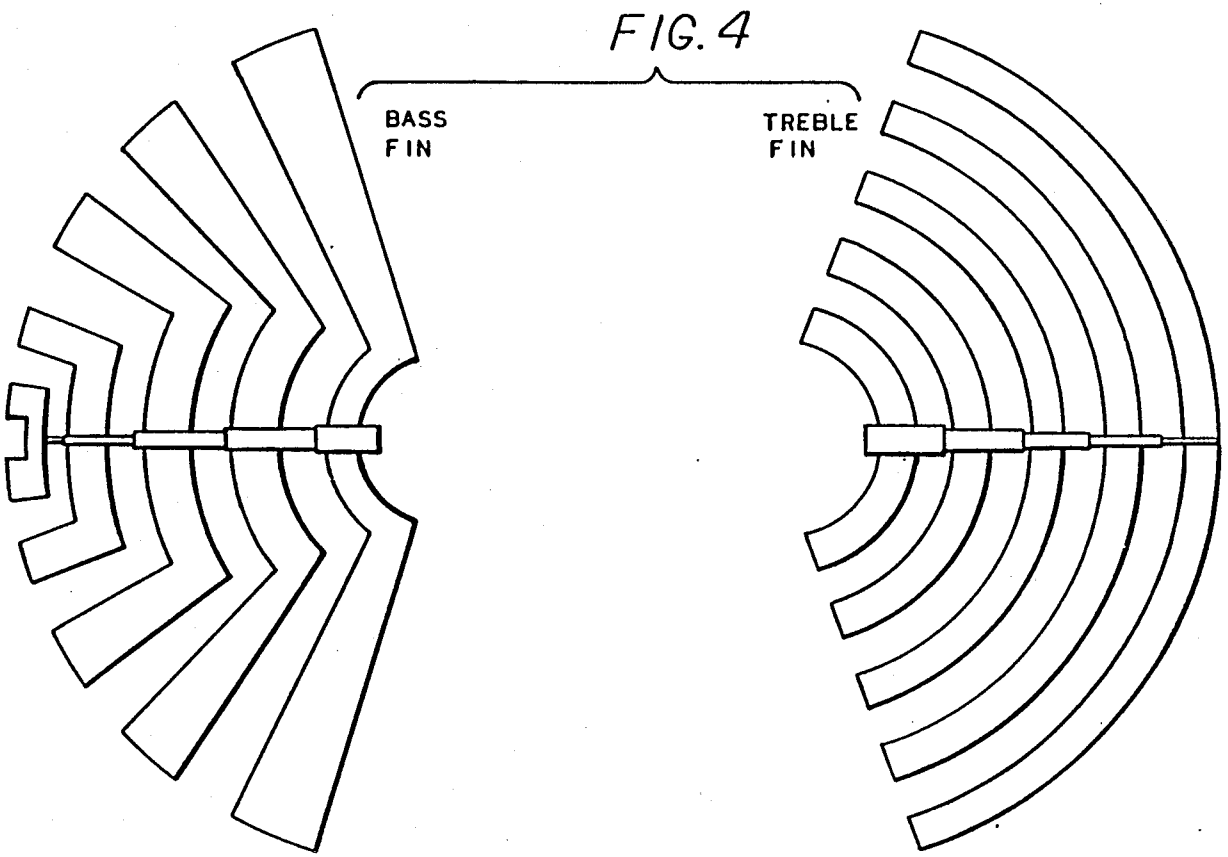
FIG. 4 shows further parts of the apparatus.

The five fins carried on any one group of drive shafts S describe a part-spherical envelope when they rotate. FIG. 2C shows the individual forms of one group of fins. The three groups differ, as FIGS. 2C and 4 show, between themselves in overall form, but the envelopes they describe when rotating are of substantially identical size and shape. The three projecting groups of fins fit neatly within the surrounding translucent sphere 13.

The Pulsar analyser splits the incoming audio signal into bass, mid-range and treble (ie frequency-based) components. The electronic circuitry applies each of those components to a respective one of the three groups of five inductive motors M. Each component is in turn split into five frequency-based signals, equally spaced in this particular instance throughout the particular frequency band of the component. Each respective motor M, and hence each drive shaft S, is energised by signals falling within the frequency band to which that particular motor M responds.

The drive motor controlling the rotation of column 12 is energised by changes in amplitude of the incoming audio signal.

Thus, in use, the column 12 and sphere 13 will be rotated one way once the amplitude of the incoming signal passes a pre-set threshold. The speed of rotation will vary directly with the amplitude above that threshold. The circuitry may be set to rotate column 12 and sphere 13 always in one direction, or in alternate directions given alternate amplitude-based motor-energising signals, or at random in either direction once the amplitude passes the pre-set threshold. Similarly the frequency-based signals will energise each of the fin-driving motors M every time each signal falls within a motor-energising frequency band, to rotate the fins F independently of one another and at intervals and speeds dependent solely on the frequency variations of the incoming analysed audio signal. Very attractive visual effects are produced by this essentially unpredictable combination of fin and sphere movements which will continue as long as the signal is supplied to the apparatus.

The compensating network is preferably included in the electronic circuitry to ensure the fastest possible response of the drive motors M to an appropriate energising signal. Also to try to guard against current surges. The electromagnetic retarder or Lancaster dampner circuits are intended to give a "stop-spin" operation of the drive shafts S without any appreciable slow-down period. If the shafts and fins are made light enough, this is a much more attractive effect than a gradual starting up and slowing down of each fin about its rotational axis.

Different combinations of signals could be used to determine which way any drive shaft rotates. For example, a treble-only signal could cause the appropriate treble-energised motor to rotate its fin clockwise, whereas a treble-and-bass signal could cause the treble fin to rotate clockwise and the appropriate bass fin to rotate anticlockwise. The following tables give some examples of possible movements.

EXAMPLE OF MOVEMENT FUNCTION REGARDING FIN ROTATION

| MUSIC COMPONENT | ROTATION |
|---|---|
| Treble only | Treble Fin rotates Clockwise direction |
| Treble & Bass | Treble, Clockwise Bass, Anticlockwise |
| Mid-Range only | Mid-Range rotates Anticlockwise |
| Mid-Range, Treble & Bass | Mid-Anticlockwise Treble, Anti. Bass, Clockwise |

EXAMPLE OF MOVEMENT FUNCTION REGARDING SPHERE ROTATION

| VOLUME | ROTATION |
|---|---|
| Loud | Fast Left |
| Quiet | Slow Left |
| Silent | Still |
| Quiet | Slow Right |
| Loud | Fast Right |
| Quiet | Slow Right |
| Silent | Still |
| Loud | Fast Left |

I claim:

1. Apparatus for providing a visual interpretation of an audio signal, comprising:

(a) an electronic analyzer including means to analyze an audio signal into a plurality of frequency components and to produce, for each frequency component, an electric signal representative of that component of the audio signal, (b) a plurality of inductive motors associated at least one with each of said components, (c) a plurality of shafts, each carrying visible indicator means drivably coupled at least one to each of said motors, (d) means mounting said shafts whereby each shaft is rotatable independently of each other shaft, and (e) motor control means between the electronic analyzer and each of said motors whereby each motor is operable independently of each other motor, and controlled by respective ones of said frequency component electric signals.

2. Apparatus according to claim 1, in which said plurality of components includes a first range of components representing base audible frequencies, a first plurality of said motors and the shafts of said motors being connected for operation in response to said first range of components, a second range of components representing mid-range audible frequencies, and a second plurality of said motors and the shafts of said motors being connected for operation in response to said second range of components, a third range of components representing treble audible frequencies, and a third plurality of said motors and the shafts of said motors being connected for operation in response to said third range of components.

3. Apparatus according to claim 2, in which each of said first, second and third pluralities of motors have the respective shafts therefrom mounted coaxially.

4. Apparatus according to claim 3, including a supporting base for said apparatus, a head rotatably mounted on said base, mounting means supporting each said plurality of coaxially mounted shafts equiangularly about said head.

5. Apparatus according to claim 4, including a translucent sphere mounted on the base enclosing the head, the motors, the shafts and the visible indicator means carried thereby.

6. Apparatus according to claim 2, in which each of the said motors is a dual-direction variable speed motor, and in which said motor control means includes means for controlling the speed and direction of each motor independently in dependence on the amplitude of the respective frequency component, the motors of each group being driven in the same direction in dependence on the ranges of the frequency components within the audio signal.

7. Apparatus according to claim 4, including a motor operatively connected to said supporting head for rotating the same on said base.

8. Apparatus according to claim 7, including means responsive to the amplitude of the audio signal to control operation of said head-rotating motor for rotating the same on said base in a predetermined manner.

* * * * *